US011345572B2

(12) United States Patent
Fang et al.

(10) Patent No.: US 11,345,572 B2
(45) Date of Patent: May 31, 2022

(54) ELEVATOR DOOR CONTROL SYSTEM, ELEVATOR SYSTEM, AND ELEVATOR DOOR CONTROL METHOD

(71) Applicant: Otis Elevator Company, Farmington, CT (US)

(72) Inventors: Hui Fang, Shanghai (CN); Zhen Jia, Shanghai (CN); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 451 days.

(21) Appl. No.: 16/418,076

(22) Filed: May 21, 2019

(65) Prior Publication Data

US 2019/0352136 A1 Nov. 21, 2019

(30) Foreign Application Priority Data

May 21, 2018 (CN) ..... 201810487047.3

(51) Int. Cl.
*B66B 13/14* (2006.01)
*B66B 13/08* (2006.01)

(52) U.S. Cl.
CPC ..... *B66B 13/146* (2013.01); *B66B 13/08* (2013.01)

(58) Field of Classification Search
CPC ..... B66B 1/3476; B66B 5/0012; B66B 2201/222; B66B 3/02; B66B 13/146; B66B 13/08
USPC ..... 187/247
See application file for complete search history.

(56) References Cited

U.S. PATENT DOCUMENTS 5,258,586 A 11/1993 Suzuki et al.
6,496,220 B2 12/2002 Landert et al.
7,079,669 B2 * 7/2006 Hashimoto ..... B66B 1/468 187/247
7,140,469 B2 * 11/2006 Deplazes ..... B66B 1/3476 187/316
7,281,610 B2 10/2007 Ylinen et al.
8,020,672 B2 * 9/2011 Lin ..... B66B 1/468 187/392

(Continued)

FOREIGN PATENT DOCUMENTS

CN 1931697 A 3/2007
DE 102013209368 A1 11/2014
WO 2016142968 A1 9/2016

*Primary Examiner* — Jeffrey Donels
(74) *Attorney, Agent, or Firm* — Cantor Colburn LLP

(57) ABSTRACT

An elevator door control system, an elevator system, and an elevator door control method based on to-be-carried object grouping identification. The elevator door control system includes one or more three-dimensional sensors, arranged to capture three-dimensional data of to-be-carried objects in an elevator waiting region, wherein the three-dimensional data includes depth data; a data processing device, communicating with the three-dimensional sensor, and configured to receive and process the three-dimensional data, to provide grouping data of one or more groups obtained according to correlations between the to-be-carried objects and position data of each to-be-carried object in the elevator waiting region; and a control device, connected to an elevator door, communicating with the data processing device, and configured to control operation of the elevator door according to the grouping data and the position data.

22 Claims, 2 Drawing Sheets

(56) References Cited

U.S. PATENT DOCUMENTS

| | | | | |
|---|---|---|---|---|
| 8,260,042 | B2 | 9/2012 | Peng et al. | |
| 9,463,953 | B2 * | 10/2016 | Lee | B66B 1/3476 |
| 9,481,548 | B2 | 11/2016 | Siddiqui et al. | |
| 10,241,486 | B2 * | 3/2019 | Finn | B66B 5/0012 |
| 10,479,647 | B2 * | 11/2019 | Hsu | B66B 1/2408 |
| 10,513,417 | B2 * | 12/2019 | Zhao | B66B 5/0012 |
| 10,532,909 | B2 * | 1/2020 | Richmond | B66B 1/2408 |
| 2015/0075914 | A1 | 3/2015 | Armistead et al. | |
| 2016/0031675 | A1 | 2/2016 | Silvennoinen et al. | |
| 2016/0292515 | A1 | 10/2016 | Jia et al. | |
| 2016/0292522 | A1 * | 10/2016 | Chen | G01C 3/08 |
| 2016/0347577 | A1 | 12/2016 | Simcik et al. | |
| 2016/0368732 | A1 * | 12/2016 | Zhao | B66B 1/468 |
| 2017/0275134 | A1 | 9/2017 | Toner et al. | |
| 2017/0327344 | A1 * | 11/2017 | Richmond | B66B 5/0012 |
| 2020/0331723 | A1 * | 10/2020 | Sudi | B66B 1/3476 |

* cited by examiner

ELEVATOR DOOR CONTROL SYSTEM, ELEVATOR SYSTEM, AND ELEVATOR DOOR CONTROL METHOD

FOREIGN PRIORITY

This application claims priority to Chinese Patent Application No. 201810487047.3, filed May 21, 2018, and all the benefits accruing therefrom under 35 U.S.C. § 119, the contents of which in its entirety are herein incorporated by reference.

TECHNICAL FIELD

The present invention relates to the technical field of elevators, and more particularly to an elevator door control system, an elevator system, and an elevator door control method based on to-be-carried object grouping identification.

BACKGROUND ART

Elevators have been widely used in modern society, bringing great convenience to people's work and daily life. Although a large variety of elevator apparatuses, devices or systems have been provided in the prior art to meet different application needs of people, these existing elevator apparatuses, devices or systems still have shortcomings and defects in such aspects as security monitoring, intelligence, user-friendliness, reliability, and user experience, and need to be further improved and optimized.

SUMMARY OF THE INVENTION

In view of this, the present invention provides an elevator door control system, an elevator system, and an elevator door control method based on to-be-carried object grouping identification, to solve at least one or more of the above-mentioned and other problems in the prior art.

First, a first aspect of the present invention provides an elevator door control system based on to-be-carried object grouping identification, with the elevator door control system including: the elevator door control system including: one or more three-dimensional sensors, arranged to capture three-dimensional data of to-be-carried objects in an elevator waiting region, where the three-dimensional data includes depth data; a data processing device, communicating with the three-dimensional sensor, and configured to receive and process the three-dimensional data, to provide grouping data of one or more groups obtained according to correlations between the to-be-carried objects and position data of each to-be-carried object in the elevator waiting region; and a control device, connected to an elevator door, communicating with the data processing device, and configured to control operation of the elevator door according to the grouping data and the position data.

In the elevator door control system according to the present invention, optionally, the control device is configured to control operation of the elevator door to simultaneously load all to-be-carried objects in at least one group or simultaneously load remaining to-be-carried objects in at least one group that have not been carried.

In the elevator door control system according to the present invention, optionally, the data processing device includes: a detecting and locating module, configured to acquire an object feature of each to-be-carried object from the three-dimensional data and determine a coordinate position of each to-be-carried object in the elevator waiting region; a grouping module, communicating with the detecting and locating module, and configured to group each to-be-carried object into a group according to the object feature; and a group tracking module, communicating with the grouping module, and configured to track positions of to-be-carried objects in the same group and update coordinate positions of the to-be-carried objects in the elevator waiting region.

In the elevator door control system according to the present invention, optionally, the data processing device further includes a category defining module, communicating with the grouping module and the group tracking module, and configured to define, according to at least two object features of the to-be-carried objects in the same group, a category of the group, wherein the at least two object features include height and shape, and the category includes an adult group, an adult and juvenile group, an adult and pet group, and a juvenile and pet group.

In the elevator door control system according to the present invention, optionally, the control device is configured to execute the following operations: if the category of the group is the adult and juvenile group, controlling, when only a juvenile in the group enters an elevator car, the elevator door to be in an open state until an adult in the group enters the elevator car; if the category of the group is the adult and pet group, controlling, when only a pet in the group enters an elevator car, the elevator door to be in an open state until an adult in the group enters the elevator car; if the category of the group is the juvenile and pet group, controlling, when only a pet in the group enters an elevator car, the elevator door to be in an open state until a juvenile in the group enters the elevator car; and/or if the category of the group is the adult group, controlling, when not all the adults in the group have entered an elevator car and a current crowdedness degree of the elevator car does not exceed a preset value, the elevator door to be in an open state until all the adults in the group enter the elevator car.

In the elevator door control system according to the present invention, optionally, the crowdedness degree is determined according to a ratio of a current load of the elevator car to a preset rated load of the elevator car.

In the elevator door control system according to the present invention, optionally, the three-dimensional sensor has a parameter that is calibrated, and the detecting and locating module converts a coordinate position of the to-be-carried object in the depth data into a coordinate position of the to-be-carried object in the elevator waiting region based on the parameter.

In the elevator door control system according to the present invention, optionally, the parameter includes a position and an angle at which the three-dimensional sensor is arranged.

In the elevator door control system according to the present invention, optionally, the detecting and locating module processes the three-dimensional data by using background modeling and foreground segmentation methods.

In the elevator door control system according to the present invention, optionally, the object feature includes position, speed, acceleration, moving direction, trajectory, body orientation, height, and shape.

In the elevator door control system according to the present invention, optionally, the three-dimensional sensor is at least arranged at the top of the elevator waiting region.

Next, a second aspect of the present invention provides an elevator system, including any one of the above-mentioned elevator door control systems.

In addition, a third aspect of the present invention further provides an elevator door control method based on to-be-carried object grouping identification, including steps of: receiving three-dimensional data captured from to-be-carried objects in an elevator waiting region, where the three-dimensional data includes depth data; processing the three-dimensional data, to provide grouping data of one or more groups obtained according to correlations between the to-be-carried objects and position data of each to-be-carried object in the elevator waiting region; and controlling operation of the elevator door according to the grouping data and the position data.

In the elevator door control method according to the present invention, optionally, the operation of the elevator door is controlled to simultaneously load all to-be-carried objects in at least one group or simultaneously load remaining to-be-carried objects in at least one group that have not been carried.

In the elevator door control method according to the present invention, optionally, the step of processing the three-dimensional data includes: acquiring an object feature of each to-be-carried object from the three-dimensional data and determining a coordinate position of each to-be-carried object in the elevator waiting region; grouping each to-be-carried object into a group according to the object feature; and tracking positions of to-be-carried objects in the same group and updating coordinate positions of the to-be-carried objects in the elevator waiting region.

In the elevator door control method according to the present invention, optionally, the step of processing the three-dimensional data further includes defining, according to at least two object features of the to-be-carried objects in the same group, a category of the group, wherein the at least two object features include height and shape, and the category includes an adult group, an adult and juvenile group, an adult and pet group, and a juvenile and pet group.

In the elevator door control method according to the present invention, optionally, the following operations are executed according to the category of the group: if the category of the group is the adult and juvenile group, controlling, when only a juvenile in the group enters an elevator car, the elevator door to be in an open state until an adult in the group enters the elevator car; if the category of the group is the adult and pet group, controlling, when only a pet in the group enters an elevator car, the elevator door to be in an open state until an adult in the group enters the elevator car; if the category of the group is the juvenile and pet group, controlling, when only a pet in the group enters an elevator car, the elevator door to be in an open state until a juvenile in the group enters the elevator car; and/or if the category of the group is the adult group, controlling, when not all the adults in the group have entered an elevator car and a current crowdedness degree of the elevator car does not exceed a preset value, the elevator door to be in an open state until all the adults in the group enter the elevator car.

In the elevator door control method according to the present invention, optionally, the crowdedness degree is determined according to a ratio of a current load of the elevator car to a preset rated load of the elevator car.

In the elevator door control method according to the present invention, optionally, the object feature includes position, speed, acceleration, moving direction, trajectory, body orientation, height, and shape.

In the elevator door control method according to the present invention, optionally, the three-dimensional data is captured by using one or more three-dimensional sensors having a parameter that is calibrated, and a coordinate position of the to-be-carried object in the depth data is converted into a coordinate position of the to-be-carried object in the elevator waiting region based on the parameter.

In the elevator door control method according to the present invention, optionally, the parameter includes a position and an angle at which the three-dimensional sensor is arranged.

In the elevator door control method according to the present invention, optionally, the three-dimensional sensor is at least arranged at the top of the elevator waiting region.

The principles, characteristics, features, advantages and the like of the technical solutions of the present invention will be apparent from the following detailed description made with reference to the accompanying drawings. For example, it will be appreciated that the elevator door control system, the elevator system, and the elevator door control method based on to-be-carried object grouping identification provided by the present invention have obvious technical advantages over the prior art, can intelligently implement quick and accurate identification of correlations between the to-be-carried objects, and accordingly distribute the associated to-be-carried objects to the same elevator car in a more user-friendly way, thus improving the safety in use of the elevator door, and enhancing user experience of passengers.

BRIEF DESCRIPTION OF THE DRAWINGS

The technical solutions of the present invention will be described in further detail with reference to the accompanying drawings and embodiments. However, it should be understood that the accompanying drawings are merely designed for the purpose of explanation, are merely intended to conceptually illustrate the structural constructions described herein, and are not necessarily drawn to scale.

DETAILED DESCRIPTION

First, it should be noted that the compositions, steps, features, and advantages of the elevator door control system, the elevator system and the elevator door control method based on to-be-carried object grouping identification according to the present invention will be described below by way of example, but the descriptions are not intended to limit the present invention.

In addition, for any single technical feature described or implied in the embodiments mentioned herein or any single technical feature shown or implied in the accompanying drawings, the present invention still allows these technical features (or equivalents thereof) to be combined or omitted arbitrarily without causing any technical obstacle. Therefore, all such embodiments obtained according to the present invention should be considered to fall within the scope disclosed herein. In addition, the same or similar components and features may be labeled at only one or more positions in the same drawing for the sake of simplicity.

Figure 1:
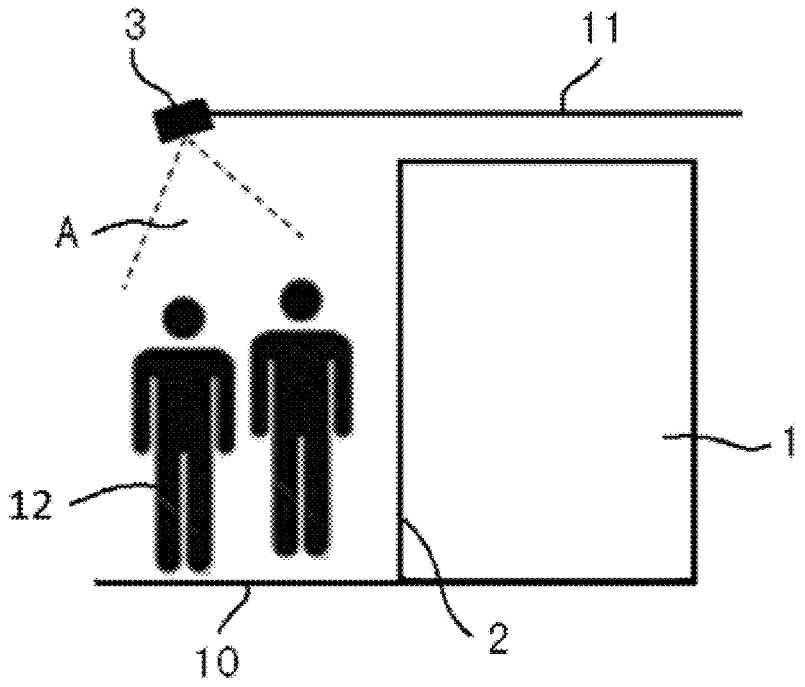
FIG. 1 is a schematic diagram of a scenario in which a plurality of to-be-carried objects is located in an elevator waiting region, where a three-dimensional sensor arranged in the elevator waiting region is shown.
Figure 2:
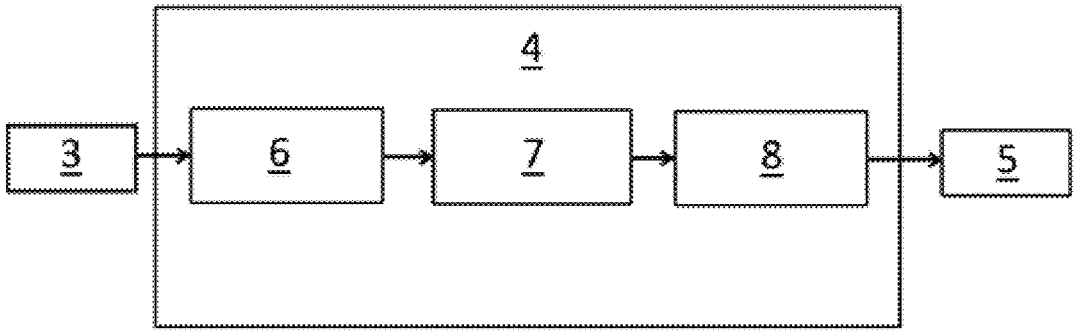
FIG. 2 is a schematic structural view of an embodiment of an elevator door control system according to the present invention.

Refer to FIG. 1 and FIG. 2, which schematically illustrate the structure of an embodiment of an elevator door control system according to the present invention. In this embodiment, the elevator door control system includes a three-dimensional sensor 3 configured to capture three-dimensional data of to-be-carried objects (for example, passengers and pets) and a data processing device 4 configured to process the captured three-dimensional data. The three-dimensional sensor (or referred to as a depth sensor) is a sensor capable of obtaining depth or three-dimensional information of an object in a scene. Such sensors may work based on different principles such as structured light, ToF, binocular stereo vision, binocular structured light, and Lidar.

Specifically, one or more three-dimensional sensors 3 (for example, commercially available ZED, Kinect, Camcube, Astra, Intel Realsense, etc.) may be provided according to actual on-site situations, for example, arranged at any suitable position such as the top 11 of the elevator waiting region 10 (or referred to as "elevator lobby", "lobby", etc.), so as to capture three-dimensional data of to-be-carried objects 12 in the elevator waiting region 10 through a field of view A formed by the one or more three-dimensional sensors 3. The three-dimensional data includes depth data, which is helpful for analysis and identification, positioning, and moving trajectory tracking of the to-be-carried objects 12, and will be detailed later. It will be appreciated that without departing from the spirit of the present invention, the actual number of three-dimensional sensors to be provided, the arrangement position, the coverage range, working parameters and the like can be flexibly selected, changed and adjusted according to specific applications requirements in the present invention.

The data processing device 4 may be connected to the three-dimensional sensor 3 through wired communication or wireless communication, so as to acquire and process the three-dimensional data captured by the three-dimensional sensor 3 and then group the to-be-carried objects 12 according to the three-dimensional data, thus grouping the to-be-carried objects 12 into one or more groups and obtaining corresponding grouping data. As an example, correlations between the to-be-carried objects 12 may be determined according to one or more object features such as position, speed, acceleration, moving direction, trajectory, body orientation, height, and shape, and accordingly the to-be-carried objects 12 are grouped into different groups. In addition, position data of the to-be-carried objects 12 in the elevator waiting region 10 may also be obtained by processing the three-dimensional data based on the data processing device 4.

Figure 3:
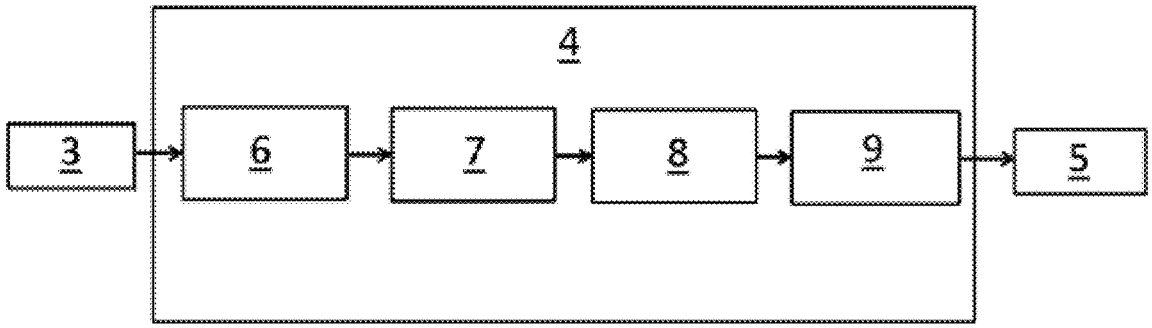
FIG. 3 is a schematic structural view of an embodiment of another elevator door control system according to the present invention.

To facilitate a better understanding of the technical solutions of the present invention, FIG. 2 and FIG. 3 respectively show approximate structures of two embodiments of the elevator door control system by way of example, wherein the data processing device 4 is implemented in two different ways.

First, in the example of FIG. 2, the data processing device 4 includes a detecting and locating module 6, a grouping module 7, and a group tracking module 8. The detecting and locating module 6 is configured to acquire an object feature (for example, position, speed, acceleration, moving direction, trajectory, body orientation, height, and shape) of each to-be-carried object 12 from the three-dimensional data captured by the three-dimensional sensor 3, and determine a coordinate position of each to-be-carried object 12 in the elevator waiting region 10. In practical applications, the detecting and locating module 6 may process the three-dimensional data by using any one or more suitable image or video (stream) analysis technologies. Such technologies include but are not limited to various 3D analysis technologies such as background modeling and foreground segmentation methods (for example, a GMM method and a codebook method). Since a large number of such methods for processing image data and depth data have been provided in the prior art, the details will not be described herein.

For the positioning of the to-be-carried object, in an optional case, parameters in the three-dimensional sensor 3 may be calibrated. The parameters include but are not limited to a position and an angle at which the three-dimensional sensor 3 is arranged. Then, the detecting and locating module 6 may convert a coordinate position of the to-be-carried object 12 in the depth data that is captured into a coordinate position of the to-be-carried object 12 in the elevator waiting region 10 based on the calibrated parameters, thus achieving timely and accurate detection and positioning of the to-be-carried objects 12.

The grouping module 7 is configured to group the to-be-carried objects 12 into one or more groups according to the object features of the to-be-carried objects 12. For example, as described above, the correlations between the to-be-carried objects 12 may be determined according to information such as position, speed, acceleration, moving direction, trajectory, and body orientation of the to-be-carried objects 12 in a plurality of frames of three-dimensional data, and accordingly the to-be-carried objects 12 are grouped. For example, if multiple to-be-carried objects have relatively stable relative positions and have similar speeds, moving directions and trajectories, it indicates that they may be friends, colleagues, family, partners or have other close or intimate relationships. In this case, they may be grouped into the same group. The information will be provided to a control device 5 for intelligent and user-friendly elevator door control, so as to distribute members of the same group into the same elevator car as much as possible.

The group tracking module 8 is configured to track positions of to-be-carried objects 12 in the same group and update coordinate positions of the to-be-carried objects 12 in the elevator waiting region 10. The information will be provided to the control device 5 for intelligent and user-friendly elevator door control, so as to distribute the to-be-carried objects of the same group into the same elevator car as much as possible.

In addition, FIG. 3 shows another example, wherein the detecting and locating module 6, the grouping module 7, and the group tracking module 8 are the same as the detecting and locating module 6, the grouping module 7, and the group tracking module 8 in FIG. 2 and therefore will not be repeatedly described herein. In the example of FIG. 3, a category defining module 9 is additionally provided. The category defining module 9 communicates with the grouping module 7 and the group tracking module 8, and is configured to define, according to two or more object features (for example, height and shape) of the to-be-carried objects in the same group, a category of the group, wherein the category may include an adult group, an adult and juvenile group, an adult and pet group, and a juvenile and pet group. The configuration of the category defining module 9 helps further intelligently distinguish individual attributes of the to-be-carried objects in the elevator waiting region 10, to enable the control device 5 to achieve more user-friendly elevator door control, thus bringing better user experience for passengers and enhancing the safety of the system, which will be detailed later.

The control device 5 is not only connected to the elevator door 2, but also communicates with the data processing device 4, so as to acquire the grouping data and the position data from the data processing device 4 and control operation of the elevator door 2. The control device 5 intelligently controls the operation of the elevator door 2 in a user-friendly way. One purpose of the control is to distribute all the to-be-carried objects 12 in the same group into the same elevator car 1 as much as possible, so as to offer care and convenience for the passengers, ensure that passengers in the same group who are family, friends, colleagues or the like take the same elevator car, and reduce or eliminate great safety risks caused by some passengers rushing and hitting the elevator door when the elevator door is being closed. In this way, not only the user experience and personal safety of passengers are improved, but also the risks of damage to elevator equipments are effectively reduced.

In an optional case, the control device 5 may be configured to execute the following one or more operations so as to better implement the above-mentioned intelligent and user-friendly elevator door control: if the category of one group is the adult and juvenile group, that is, the group includes both an adult and a juvenile, controlling, when only the juvenile in the group enters the elevator car 1, the elevator door 2 to be in an open state until the adult in the group also enters the elevator car 1, preventing the juvenile from detaching from the adult and taking the elevator alone to face safety risks; if the category of one group is the adult and pet group, that is, the group includes both an adults and a pet, controlling, when only the pet in the group enters the elevator car 1, the elevator door 2 to be in an open state until the adult in the group also enters the elevator car 1, to take care of and manage the pet, preventing the pet from detaching from the adult to annoy or cause adverse effects and safety risks to other passengers in the elevator car; if the category of one group is juvenile and pet group, that is, the group includes both a juvenile and a pet, controlling, when only the pet in the group enters the elevator car 1, the elevator door 2 to be in an open state until the juvenile in the group also enters the elevator car 1, to take care of and manage the pet, preventing the pet from detaching from the juvenile to annoy or cause adverse effects and safety risks to other passengers in the elevator car; and if the category of one group is the adult group, that is, the group includes two or more adults considered to be family, friends, colleagues or have other close or intimate relationships, controlling, when not all the adults in the group have entered the elevator car 1 and a current crowdedness degree of the elevator car 1 (which may be determined according to a ratio of a current load of the elevator car 1 to a preset rated load of the elevator car 1) does not exceed a preset value (which may be determined according to specific applications), the elevator door 2 to be in an open state until all the adults enter the elevator car 1, bringing great convenience for the adult passengers, and offering them good experience in using the elevator.

Definitely, the control device 5 may optionally be further configured to control operation of the elevator door to simultaneously load remaining to-be-carried objects in at least one group that have not been carried. For example, the elevator car may be too crowded and cannot hold all the to-be-carried objects in the same group. That is, the elevator car currently only carries some of the to-be-carried objects in the group, and one or more remaining to-be-carried objects in the same group need to wait in the elevator waiting region for next ride. In this case, the control device 5 can be used to control operation of the elevator door of the elevator that subsequently comes, so as to distribute as much as possible the remaining to-be-carried objects to one elevator car at a time or to a plurality of elevator cars in batches, thus providing intelligent and user-friendly elevator control, and minimizing the number of elevator cars required for carrying the to-be-carried objects in the same group.

The approximate structures, working principles, and technical advantages of the elevator door control system according to the present invention have been described in detail with reference to the examples of FIG. 1 to FIG. 2. In addition, another technical solution according to the present invention further provides an elevator system, including the elevator door control system according to the present invention, so as to exploit the obvious technical advantages of the solutions of the present invention over the prior art.

Figure 4:
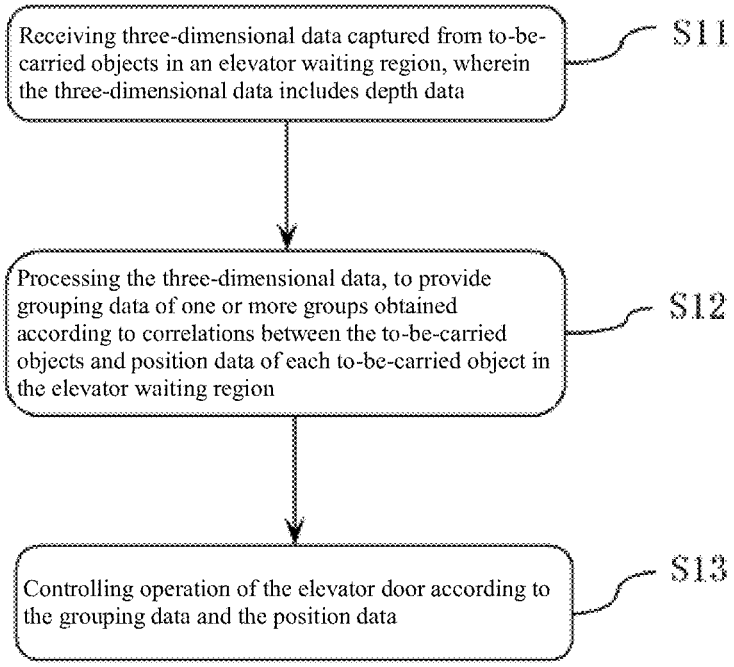
FIG. 4 is a schematic flowchart of an embodiment of an elevator door control method according to the present invention.

In addition, as an aspect obviously superior to the prior art, the present invention further provides an elevator door control method based on to-be-carried object grouping identification. As an example, as shown in FIG. 4, one example of the elevator door control method may include the following steps:

In step S11, receiving three-dimensional data captured from to-be-carried objects in an elevator waiting region, wherein the three-dimensional data includes depth data;

In step S12, processing the three-dimensional data, to provide grouping data of one or more groups obtained according to correlations between the to-be-carried objects and position data of each to-be-carried object in the elevator waiting region; and In step S13, controlling operation of the elevator door according to the grouping data and the position data.

For example, in some embodiments, the operation of the elevator door may be controlled in step S13 to simultaneously load all to-be-carried objects in at least one group or simultaneously load remaining to-be-carried objects in at least one group that have not been carried, thus providing intelligent and user-friendly elevator control, and minimizing the number of elevator cars required for carrying the to-be-carried objects in the same group.

In an optional case, the received three-dimensional data may be processed in the following manner in some embodiments: first, acquiring an object feature (for example, position, speed, acceleration, moving direction, trajectory, body orientation, height, and significance) of each to-be-carried object from the three-dimensional data and determining a coordinate position of each to-be-carried object in the elevator waiting region; then, grouping each to-be-carried object into a group according to the object feature; and then, tracking positions of to-be-carried objects in the same group and updating coordinate positions of the to-be-carried objects in the elevator waiting region.

In addition, in an optional case, the to-be-carried object may be detected and positioned by using methods such as background modeling and foreground segmentation.

In addition, in an optional case, the three-dimensional data of the to-be-carried objects in the elevator waiting region may be captured by using one or more three-dimensional sensors having a parameter that is calibrated (for example, a position and an angle at which the three-dimensional sensor is arranged), and a coordinate position of the to-be-carried object in the depth data is converted into a coordinate position of the to-be-carried object in the elevator waiting region based on the above parameter.

In some embodiments, according to two or more object features (for example, height and shape) of the to-be-carried objects in the same group, a category of the group may be defined. For example, the category may be set to include an adult group, an adult and juvenile group, an adult and pet group, and a juvenile and pet group. Based on the classification and setting of the categories of the groups, the operation of the elevator door can be intelligently controlled in a user-friendly way according to the categories of different groups, to prevent the annoyance, adverse effects, and safety risks caused by the juvenile or pet from detaching from the adult, the pet from detaching from the juvenile, or that passengers in the same group not taking the same elevator car, thus improving better user experience for passengers, It will be appreciated that the technical contents such as the grouping and setting of the to-be-carried objects, the setting of the categories of groups, the detection, positioning and tracking of the to-be-carried objects, the intelligent and user-friendly control operation on the elevator door, and the configuration and use of the three-dimensional sensor have been elaborated thoroughly in the foregoing description of the elevator door control system; therefore, for contents related to the method of the present invention, reference can be made to the specific description of the foregoing corresponding part, and the details will not be repeated herein.

The elevator door control system, the elevator system and the elevator door control method based on to-be-carried object grouping identification according to the present invention are described in detail above by way of example only. These examples are only used for describing the principles and implementations of the present invention, and are not intended to limit the present invention. Those of ordinary skill in the art can also make various modifications and improvements without departing from the spirit and scope of the present invention. Therefore, all equivalent technical solutions shall fall within the scope of the present invention as defined by the appended claims.

What is claimed is:

1. An elevator door control system based on to-be-carried object grouping identification, comprising:

one or more three-dimensional sensors, arranged to capture three-dimensional data of to-be-carried objects in an elevator waiting region, wherein the three-dimensional data comprises depth data;

a data processing device, communicating with the three-dimensional sensor, and configured to receive and process the three-dimensional data, to provide grouping data of one or more groups obtained according to correlations between the to-be-carried objects and position data of each to-be-carried object in the elevator waiting region; and a control device, connected to an elevator door, communicating with the data processing device, and configured to control operation of the elevator door according to the grouping data and the position data.

2. The elevator door control system according to claim 1, wherein the control device is configured to control operation of the elevator door to simultaneously load all to-be-carried objects in at least one group or simultaneously load remaining to-be-carried objects in at least one group that have not been carried.

3. The elevator door control system according to claim 1, wherein the data processing device comprises:

a detecting and locating module, configured to acquire an object feature of each to-be-carried object from the three-dimensional data and determine a coordinate position of each to-be-carried object in the elevator waiting region;

a grouping module, communicating with the detecting and locating module, and configured to group each to-be-carried object into a group according to the object feature; and a group tracking module, communicating with the grouping module, and configured to track positions of to-be-carried objects in the same group and update coordinate positions of the to-be-carried objects in the elevator waiting region.

4. The elevator door control system according to claim 3, wherein the data processing device further comprises a category defining module, communicating with the grouping module and the group tracking module, and configured to define, according to at least two object features of the to-be-carried objects in the same group, a category of the group, wherein the at least two object features comprise height and shape, and the category comprises an adult group, an adult and juvenile group, an adult and pet group, and a juvenile and pet group.

5. The elevator door control system according to claim 4, wherein the control device is configured to execute one of the following operations:

if the category of the group is the adult and juvenile group, controlling, when only a juvenile in the group enters an elevator car, the elevator door to be in an open state until an adult in the group enters the elevator car;

if the category of the group is the adult and pet group, controlling, when only a pet in the group enters an elevator car, the elevator door to be in an open state until an adult in the group enters the elevator car;

if the category of the group is the juvenile and pet group, controlling, when only a pet in the group enters an elevator car, the elevator door to be in an open state until a juvenile in the group enters the elevator car;

if the category of the group is the adult group, controlling, when not all the adults in the group have entered an elevator car and a current crowdedness degree of the elevator car does not exceed a preset value, the elevator door to be in an open state until all the adults in the group enter the elevator car.

6. The elevator door control system according to claim 5, wherein the crowdedness degree is determined according to a ratio of a current load of the elevator car to a preset rated load of the elevator car.

7. The elevator door control system according to claim 3, wherein the three-dimensional sensor has a parameter that is calibrated, and the detecting and locating module converts a coordinate position of the to-be-carried object in the depth data into a coordinate position of the to-be-carried object in the elevator waiting region based on the parameter.

8. The elevator door control system according to claim 7, wherein the parameter comprises a position and an angle at which the three-dimensional sensor is arranged.

9. The elevator door control system according to claim 3, wherein the detecting and locating module processes the three-dimensional data by using background modeling and foreground segmentation methods.

10. The elevator door control system according to claim 3, wherein the object feature comprises position, speed, acceleration, moving direction, trajectory, body orientation, height, and shape.

11. The elevator door control system according to claim 1, wherein the three-dimensional sensor is at least arranged at the top of the elevator waiting region.

12. An elevator system, comprising:

an elevator car; and the elevator door control system according to claim 1.

13. An elevator door control method based on to-be-carried object grouping identification, the method comprising:

receiving three-dimensional data captured from to-be-carried objects in an elevator waiting region, wherein the three-dimensional data comprises depth data;

processing the three-dimensional data, to provide grouping data of one or more groups obtained according to correlations between the to-be-carried objects and position data of each to-be-carried object in the elevator waiting region; and controlling operation of the elevator door according to the grouping data and the position data.

14. The elevator door control method according to claim 13, wherein the operation of the elevator door is controlled to simultaneously load all to-be-carried objects in at least one group or simultaneously load remaining to-be-carried objects in at least one group that have not been carried.

15. The elevator door control method according to claim 13, wherein the processing the three-dimensional data comprises:

acquiring an object feature of each to-be-carried object from the three-dimensional data and determining a coordinate position of each to-be-carried object in the elevator waiting region;

grouping each to-be-carried object into a group according to the object feature; and tracking positions of to-be-carried objects in the same group and updating coordinate positions of the to-be-carried objects in the elevator waiting region.

16. The elevator door control method according to claim 15, wherein the processing the three-dimensional data further comprises defining, according to at least two object features of the to-be-carried objects in the same group, a category of the group, wherein the at least two object features comprise height and shape, and the category comprises an adult group, an adult and juvenile group, an adult and pet group, and a juvenile and pet group.

17. The elevator door control method according to claim 16, wherein one of the following operations are executed according to the category of the group:

if the category of the group is the adult and juvenile group, controlling, when only a juvenile in the group enters an elevator car, the elevator door to be in an open state until an adult in the group enters the elevator car;

if the category of the group is the adult and pet group, controlling, when only a pet in the group enters an elevator car, the elevator door to be in an open state until an adult in the group enters the elevator car;

if the category of the group is the juvenile and pet group, controlling, when only a pet in the group enters an elevator car, the elevator door to be in an open state until a juvenile in the group enters the elevator car; and/or if the category of the group is the adult group, controlling, when not all the adults in the group have entered an elevator car and a current crowdedness degree of the elevator car does not exceed a preset value, the elevator door to be in an open state until all the adults in the group enter the elevator car.

18. The elevator door control method according to claim 17, wherein the crowdedness degree is determined according to a ratio of a current load of the elevator car to a preset rated load of the elevator car.

19. The elevator door control method according to claim 15, wherein the object feature comprises position, speed, acceleration, moving direction, trajectory, body orientation, height, and shape.

20. The elevator door control method according to claim 13, wherein the three-dimensional data is captured by using one or more three-dimensional sensors having a parameter that is calibrated, and a coordinate position of the to-be-carried object in the depth data is converted into a coordinate position of the to-be-carried object in the elevator waiting region based on the parameter.

21. The elevator door control method according to claim 20, wherein the parameter comprises a position and an angle at which the three-dimensional sensor is arranged.

22. The elevator door control method according to claim 20, wherein the three-dimensional sensor is at least arranged at the top of the elevator waiting region.

* * * * *